US005171384A

United States Patent [19]

Igawa et al.

[11] Patent Number: 5,171,384

[45] Date of Patent: Dec. 15, 1992

[54] PROCESS FOR PRODUCING HIGH STRENGTH STAINLESS STEEL STRIP EXCELLENT IN SHAPE

[75] Inventors: Takashi Igawa, Yamaguchi; Yoshihiro Uematsu, Kudamatsu; Toshihiko Takemoto, Tokuyama, all of Japan

[73] Assignee: Nisshin Steel Co., Ltd., Tokyo, Japan

[21] Appl. No.: 773,816

[22] Filed: Oct. 9, 1991

[30] Foreign Application Priority Data

Oct. 16, 1990 [JP] Japan ..... 2-275423

[51] Int. Cl.[5] ..... C21D 8/02

[52] U.S. Cl. ..... 148/611; 148/325

[58] Field of Search ..... 148/12 E, 12 EA, 12 B, 148/605, 325, 611

[56] References Cited

U.S. PATENT DOCUMENTS 4,878,955 11/1989 Hoshino et al. ..... 148/325

*Primary Examiner*—R. Dean
*Assistant Examiner*—Sikyin Ip
*Attorney, Agent, or Firm*—Lowe, Price, LeBlanc & Becker

[57] ABSTRACT

A high strength steel strip excellent in shape having a duplex structure of austenite and martensite has been prepared by a process which comprises providing a cold rolled or cold rolled and annealed strip of a martensitic structure from low carbon martensitic stainless steel containing from 10 to 17% by weight of Cr and having a carbon content of not exceeding 0.15% by weight, causing the strip to continuously pass through a continuous heat treatment furnace under tension where the strip is heated to temperatures within the range from (the As point of the steel + 30° C.) to the Af point of the steel and not higher than 900° C. so that a part of the martensitic phase may be changed to a reversed austenitic phase, and cooling the heated strip to ambient temperature, wherein the As point of the steel is a temperature of the steel of which temperature is being raised at which the transformation of martensite to austenite begins and the Af point of the steel is a temperature of the steel of which temperature is being raised at which the transformation of martensite to austenite is finished.

5 Claims, 1 Drawing Sheet

PROCESS FOR PRODUCING HIGH STRENGTH STAINLESS STEEL STRIP EXCELLENT IN SHAPE

FIELD OF THE INVENTION

The invention relates to a process for the production of a high strength stainless steel strip excellent in shape.

BACKGROUND OF THE INVENTION

As high strength stainless steels having a tensile strength of the order of 100 kgf/mm$^2$ or more, there are known work hardened austenitic stainless steels, low carbon martensitic stainless steels and precipitation hardened stainless steels. These stainless steels, because of their excellent fatigue properties, corrosion resistance and heat resistance, are widely used for the production of steel belts and various springs. Such materials for steel belts and processes for the production of a steel belt are disclosed in, for example, JP B 51-31085 and JP B 61-9903.

Work hardened austenitic stainless strips are prepared by processes comprising cold rolling a metastable austenitic stainless strip to impart work induced strain and tempering the cold rolled strip. Whereas low carbon martensitic stainless steel strips are prepared by processes comprising quenching a strip of low carbon, Cr-Ni stainless steel whose chemical composition has been adjusted so that the steel has a lath martensitic structure at ambient structure from an annealing temperature which is normally 900° C. or higher. In any event, in order to produce a stainless steel strip of having a good shape, the production process must include a final rolling step for shape rectification in which a rolling machine equipped with large diameter rolls is used. This step of rolling for shape rectification should be appropriately carried out, while carefully selecting conditions including, for example, rolling reduction, diameters of rolls and rate of rolling, depending upon the steel species, thickness of the strip and histories of the precedent production steps, or otherwise a flat stainless steel strip cannot be obtained and the production yield is reduced. Accordingly, it is eagerly desired to prepare a stainless steel strip excellent in flatness without the rolling step for shape rectification. Unfortunately, the desired technology is not yet established on the concerned steel species.

OBJECT OF THE INVENTION

An object of the invention is to solve the above discussed problem associated with the prior art and to provide a process for the production of a high strength stainless steel strip having a tensile strength of the order of 100 kgf/mm$^2$ or more and an excellent shape, said process need not include the final rolling step for shape rectification.

SUMMARY OF THE INVENTION

According to the invention there is provided a process for the production of a high strength stainless steel strip excellent in shape having a duplex structure of austenite and martensite which comprises providing a cold rolled or cold rolled and annealed strip of a martensitic structure from low carbon martensitic stainless steel containing from 10 to 17% by weight of Cr and having a carbon content of not exceeding 0.15% by weight, causing the strip to continuously pass through a continuous heat treatment furnace where the strip is heated to temperatures within the range from (the As point of the steel +30° C.) to the Af point of the steel and not higher than 900° C. so that a part of the martensitic phase may be changed to a reversed austenitic phase, and cooling the heated strip to ambient temperature, wherein the As point of the steel is a temperature of the steel of which temperature is being raised at which the transformation of martensite to austenite begins and the Af point of the steel is a temperature of the steel of which temperature is being raised at which the transformation of martensite to austenite is finished.

If a tension of the strip passing through the heat treatment furnace is lowered as it is heated from a lower temperature side to a higher temperature side, better results are obtained. This adjustment of the tension is conveniently carried out by adjusting a tension due to the own weight of the strip passing through the furnace, that is, by adjusting the distance between adjacent rolls supporting the strip in the furnace. The strip may be substantially martensitic or it may contain up to 20% by volume of a ferritic or austenitic phase before it is caused pass through the continuous heat treatment furnace.

Function

In the process according to the invention, a stainless steel strip passing through a continuous heat treatment furnace is continuously heated under a tension exerting in the longitudinal direction of the strip. The continuous heat treatment according to the invention in which the strip is heated under a tension is distinct from a batchwise heat treatment in which a strip in the form of a coil is heated under no tension. When a martensitic stainless steel strip is heated in a continuous heat treatment furnace to a temperature above the As point of the steel, the martensite is reversed to austenite under a tension exerting in the longitudinal direction of the strip. Since this reversion proceeds under a tension exerting in the longitudinal direction of the strip, the material is flattened as the reversion proceeds. If the heat treatment temperature used is within the range from (the As point of the steel +30° C.) to the Af point of the steel and not higher than 900° C., a part of the martensitic phase may be changed to a reversed austenitic phase.

The reversed austenite is fine and so stable that it is not retransformed to quenched martensite when cooled to ambient temperature. Thus, the steel strip produced by the process according to the invention has a fine duplex structure of martensite and reversed austenite and has a high strength.

The fact that the reversed austenite is not retransformed to quenched martensite upon cooling from the heat treatment temperature means occurrence of no strain due to quenching, indicating that the good flatness of the strip achieved in the heat treatment furnace can be retained to ambient temperature.

PREFERRED EMBODIMENTS OF THE INVENTION

Figure 1:
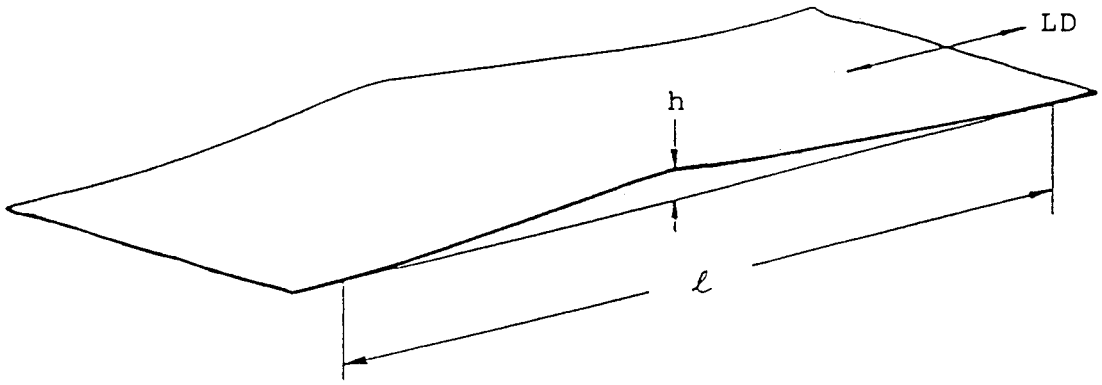
FIG. 1 is a perspective view of a strip for illustrating an LD shape value used herein.

Catenary furnaces and vertical furnaces normally used in annealing a strip may be used as the continuous heat treatment furnace in carrying out the process according to the invention. The atmosphere of the furnace may be air, but if oxidation of the strip should be avoided, reducing or inert gases may be used. While the furnace is conveniently heated electrically, it may be heated by fuel combustion as well. Upon the continuous heat treatment according to the invention a tension necessarily exerts on the strip in the longitudinal direction. A suitable tension is 0.5 kgf/mm$^2$ or higher at a low temperature side near the As point of the steel. Whereas at a higher temperature side near the Af point of the steel a relatively low tension below 0.5 kgf/mm$^2$ is preferred. The adjustment of the tension may be conveniently carried out by adjusting the distance of adjacent rolls supporting the strip in the furnace.

By the continuous heat treatment according to the invention a desirably fine duplex structure is realized and by maintaining the fine duplex structure there can be produced a high strength steel strip excellent in shape. Accordingly, upon the heat treatment it is essential to form a desirably stable and fine duplex structure. If the heat treatment temperature is substantially lower than (the As point of the steel +30° C.), the amount of the reversed austenite is insufficient, or if the heat treatment temperature is higher than 900° C. or the Af point of the steel, a large amount of austenite is formed, retaining no or an insufficient amount of martensite, and thus, the desired stable and fine duplex structure is not obtained. Accordingly, the heat treatment should be carried out at a temperature within the range from (the As point of the steel +30° C.) to the Af point of the steel and not higher than 900° C.

The steel used herein is substantially martensitic in the annealed condition. The structure of the strip prior to the heat treatment should be substantially martensitic. The starting strip may be an annealed steel strip which has been made martensitic in the final annealing step, a cold rolled steel strip prepared by finish cold rolling the above mentioned annealed steel strip, or a cold rolled strip in which strain induced martensite has been formed by cold rolling. The structure of the steel strip prior to the heat treatment need not be 100% martensitic. The presence of a minor amount, for example, up to 20% by volume, of ferrite or austenite is permissible. In any event, it is intended that the ultimate strip should have a tensile strength as high as the order of 100 kgf/mm$^2$ or higher in the heat treated condition.

As to the chemical composition, the steel used herein is a low carbon martensitic stainless steel containing from 10 to 17% by weight of Cr and having a carbon content of not exceeding 0.15% by weight. Ni can also be a principal alloying element. Furthermore, the steel may contain other alloying elements normally contained in low carbon martensitic stainless steel.

Typical alloying elements and contents thereof by weight are as follows:

C: 0.15% or less (exclusive 0),
Si: 6.0% or less (exclusive 0),
Mn: 10.0% or less (exclusive 0),
Ni: 8.0% or less (exclusive 0),
Cr: 10.0 to 17.0%,
N: 0.3% or less (exclusive 0),
Mo: 4.0% or less (inclusive 0),
Cu: 4.0% or less (inclusive 0),
Co: 4.0% or less (inclusive 0).

In addition, the steel used herein may contain Ti, Al, Nb, V, Zr, B and rare earth elements in an amount of 1.0% or less in total, and unavoidable impurities.

Furthermore, amounts of the alloying elements are mutually controlled so that the nickel equivalent, $Ni_{eq}$, of the steel may fall within the range between 8.0 and 17.5. The nickel equivalent, $Ni_{eq}$, of the steel is defined as follows.

$$Ni_{eq}=Ni+Mn+Cu+Mo+0.2Co+0.5Cr+0.3Si+20(C+N),$$

in the case wherein the steel contains none of Ti, Al, Nb, V, Zr, B and rare earth elements, whereas $$Ni_{eq}=Ni+Mn+Cu+Mo+0.2Co+0.5Cr+0.3Si$$

in the case wherein the steel contains any one of Ti, Al, Nb, V, Zr, B and rare earth elements.

The reasons for such numerical restriction are as noted below.

C is an austenite forming element and serves not only to effectively stabilize the reversed austenitic phase formed during the heat treatment according to the invention at a temperature within the range from (the As point of the steel +30° C.) to the Af point of the steel but also to effectively strengthen the martensitic and reversed austenitic phases. However, the presence of an excessive amount of C results in the formation of Cr carbide during the heat treatment step which Cr carbide may impair the corrosion resistance of the steel. Accordingly, the upper limit of C is set herein as 0.15%.

Cr is a basic alloying element of stainless steels, and at least 10.0% of Cr is required to achieve a satisfactory corrosion resistance. However, since Cr is a ferrite forming element, the presence of an excessive amount of Cr results in the formation of a quantity of δ ferrite, and therefore, in the production of the starting strip, it is difficult to achieve a substantially martensitic phase after annealing and cooling to ambient temperature. Accordingly, the upper limit of Cr is set herein as 17.0%.

Ni is an austenite forming element and serves to effectively stabilize the reversed austenite phase formed during the heat treatment according to the invention at a temperature within the range from (the As point of the steel +30° C.) to the Af point of the steel. However, if the Ni content is unduly high, in the production of the starting strip, it is difficult to achieve a substantially martensitic phase after annealing and cooling to ambient temperature. Accordingly, the content of Ni is preferably 8.0% or less.

Si acts to broaden the temperature range between the As and Af points. This is advantageous in obtaining a stable duplex structure of austenite and martensite. Si further serves to effectively strengthen the martensitic and reversed austenitic phases formed in the heat treatment according to the invention. However, the production of a steel strip having an unduly high Si content is not easy. Accordingly, the content of Si is preferably 6.0% or less.

Mn is an austenite forming element and serves to effectively stabilize the reversed austenitic phase formed during the heat treatment according to the invention at a temperature within the range from (the As point of the steel +30° C.) to the Af point of the steel. However, if the Mn content is unduly high, there happens such a trouble that Mn fume is formed in the production of such a high Mn steel by melting. Accordingly, the content of Mn is preferably 10.0% or less.

N is an austenite forming element as C is and serves not only to effectively stabilize the reversed austenitic phase formed during the heat treatment according to the invention at a temperature within the range from (the As point of the steel +30° C.) to the Af point of the steel but also to effectively strengthen the martensitic and reversed austenitic phases. However, the presence of an excessive amount of N results in the formation of blow holes in the production of such a high N steel by melting, and thus does not provide a sound ingot. Accordingly, the content of N is preferably 0.30% or less.

Mo serves not only to enhance the corrosion resistance of the steel but also to effectively strengthen the martensitic and reversed austenitic phases formed in the heat treatment according to the invention. However, since Mo is a ferrite forming element, the presence of an excessive amount of Mo results in the formation of a quantity of δ ferrite, and therefore, in the production of the strip, it is difficult to achieve a substantially martensitic phase after annealing and cooling to ambient temperature. Accordingly, the content of Mo is preferably 4.0% or less.

Cu is an austenite forming element as Ni is and effective in the formation of austenite during the heat treatment according to the invention. However, the presence of an excessive amount of Cu adversely affects the hot workability of the steel. Accordingly, the content of Cu is preferably 4.0% or less.

Co is an austenite forming element as Ni is and effective in the formation of austenite during the heat treatment according to the invention. However, since Co is expensive, the content of Co is preferably 4.0% or less.

Ti, Al, Nb, V and Zr are effective not only in maintaining the stable, fine and uniform duplex structure of martensite and reversed austenite but also in suppressing the formation of Cr carbide to maintain the corrosion resistance. However, since the presence of unduly high amounts of these elements adversely affects the easiness of the production of the steel strip, the amounts of these elements are preferably 1.0% or less in total.

As already discussed, in the process according to the invention, a high strength stainless steel strip having excellent fatigue properties can be produced by reversing a part of martensite to fine austenite to form a fine duplex structure and maintaining the fine duplex structure. Accordingly, it is essential to form a stable and fine duplex structure. If the nickel equivalent, $Ni_{eq}$, of the steel is substantially below 8.0, the amount of the reversed austenite formed during the heat treatment at a relatively low temperature within the range of between (the As point +30° C.) and the Af point is insufficient, or if $Ni_{eq}$ is substantially higher than 17.5, the amount of the reversed austenite becomes excessively large, and thus, it becomes difficult to realize the desirably stable and fine duplex structure. Accordingly, amounts of alloying elements of the steel are preferably adjusted so that the nickel equivalent, $Ni_{eq}$, of the steel may fall within the range between 8.0 and 17.5.

Examples

Each steel having a composition indicated in Table 1 was prepared by melting, forged, hot rolled to a thickness of 6 mm, solution treated, pickled, cold rolled, annealed, and finish cold rolled to a thickness of 1 mm. For a purpose of confirming a beneficial effect of shape rectification during the heat treatment according to the invention, cold rolling conditions used were willfully selected so that a cold rolled material having a bad shape might be obtained. Some of the finish cold rolled strips were annealed at a temperature of 1030° C. and pickled. Table 1 indicates the As and Af transformation points of the steels tested as well. These transformation points were determined from inflection points of a temperature-electrical resistance curve obtained on each steel the temperature of which was being raised at a rate of 1° C./min. in an electrical resistance measuring device.

Figure 2:
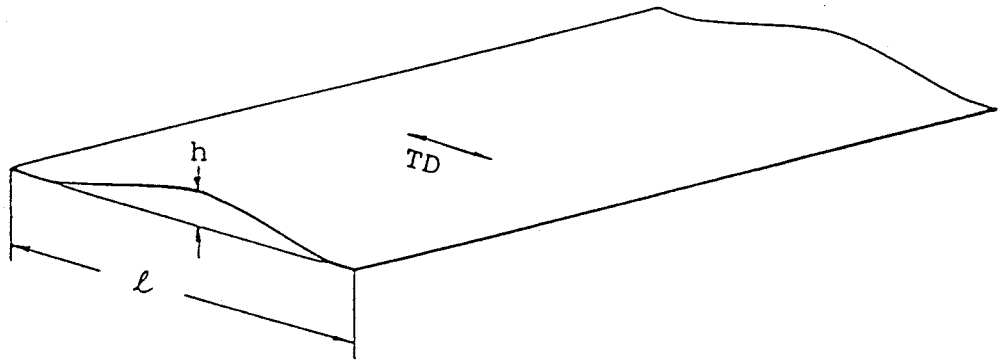
FIG. 2 a perspective view of a strip for illustrating a TD shape value used herein.

Each steel strip was heat treated in a continuous heat treatment furnace under conditions indicated in Table 2. In each run, the speed of the strip was adjusted so that it might pass through the furnace in 6 minutes. After the heat treatment a specimen was taken from the heat treated strip and tested for the proof strength and tensile strength. Furthermore, the shape of the strip was examined before and after the heat treatment. Results are shown in Table 2, wherein the LD shape value is a height of an undulation h (mm) divided by a length 1 (mm) in the rolling direction, as shown in FIG. 2, while the TD shape value is a height of an undulation h (mm) divided by a width 1 (300 mm) of the strip, as shown in FIG. 3.

From the results shown in Table 2, it is understood that all strips prepared by the process according to the invention have a high strength represented by the proof strength as high as at least 90 kgf/mm$^2$ and an excellent shape represented by an LD shape value of not in excess of 2/1000 and a TD shape value of not in excess of 1.5/300. In contrast, strips prepared in control Runs Nos. 2, 6, 9 14 and 15 outside the scope of the invention have a bad shape and/or a low proof strength.

TABLE 1

Chemical Composition and Transformation Points of Steels

| Steel No. | Elements (wt. %) C | Si | Mn | Ni | Cr | N | Others | | $Ni_{eq}$ | As (°C.) | Af (°C.) | Metal Structure |
|---|---|---|---|---|---|---|---|---|---|---|---|---|
| A1 | 0.02 | 0.52 | 0.89 | 4.96 | 14.21 | 0.01 | — | | 13.7 | 607 | 771 | Martensite |
| A2 | 0.10 | 0.37 | 0.51 | 1.02 | 12.06 | 0.02 | Mo: 1.02 | | 11.1 | 649 | 789 | Martensite |
| A3 | 0.04 | 0.41 | 0.79 | 0.45 | 12.55 | 0.03 | Mo: 0.56 | Ti: 0.34 | 8.2 | 618 | 756 | Martensite |
| A4 | 0.01 | 0.33 | 1.53 | 3.11 | 15.55 | 0.02 | Cu: 2.75 | Nb: 0.25 | 15.3 | 595 | 755 | Martensite |
| A5 | 0.03 | 0.45 | 5.07 | 2.78 | 14.21 | 0.02 | Co: 2.01 | V: 0.31 | 15.5 | 558 | 707 | Martensite |
| A6 | 0.02 | 3.02 | 2.72 | 6.83 | 13.69 | 0.01 | Al: 0.23 | B: 0.009 | 17.3 | 582 | 871 | Martensite |
| A7 | 0.02 | 4.08 | 0.22 | 7.19 | 13.33 | 0.02 | Ti: 0.19 | REM: 0.010 | 15.3 | 602 | 938 | Martensite |
| A8* | 0.05 | 0.68 | 0.33 | 4.05 | 12.79 | 0.01 | Ti: 0.37 | | 11.0 | 637 | 781 | Martensite |
| A9* | 0.11 | 0.53 | 1.09 | 6.95 | 16.47 | 0.02 | — | | 19.1 | 483 | 662 | Austenite |

A8*: Control, low carbon martencitic stainless steel

A9*: Control, work hardenable austenitic stainless steel

TABLE 2

| | | | Shape Before and After Heat Treatment and Mechanical Properties after Heat Treatment | | | | | | | |
|---|---|---|---|---|---|---|---|---|---|---|
| | | | Cold Rolling | Heat Treating | Shape Before Heat Treatment | | Shape After Heat Treatment | | $\sigma_{0.2}$ | Tensile |
| | Run No. | Steel No. | Reduction Rate (%) | Temperature (°C.) | LD h/l (mm) | TD h/l (mm) | LD h/l (mm) | TD h/l (mm) | Proof (kgf/mm$^2$) | Strength (kgf/mm$^2$) |
| Invention | 1 | A1 | 83 | 700 | 73/1000 | 31/300 | 1/1000 | 1/300 | 111 | 123 |
| Control | 2 | A1 | 83 | 1030* | 73/1000 | 31/300 | 30/1000 | 20/300 | 65 | 102 |
| Invention | 3 | A1 | 63 | 700 | 73/1000 | 31/300 | 1/1000 | 1/300 | 102 | 119 |
| Invention | 4 | A1 | 30 | 700 | 73/1000 | 31/300 | 0.5/1000 | 0.5/300 | 95 | 115 |
| Invention | 5 | A1 | 0 | 700 | 30/1000 | 21/300 | 0.5/1000 | 0.5/300 | 93 | 116 |
| Control | 6 | A1 | 0 | 950* | 30/1000 | 21/300 | 28/1000 | 18/300 | 62 | 103 |
| Invention | 7 | A2 | 67 | 750 | 83/900 | 39/300 | 2.5/1000 | 1.5/300 | 101 | 118 |
| Invention | 8 | A3 | 67 | 720 | 68/1050 | 30/300 | 2/1000 | 1/300 | 95 | 118 |
| Control | 9 | A3 | 67 | 600* | 68/1050 | 30/300 | 2.5/1000 | 23/300 | 119 | 125 |
| Invention | 10 | A4 | 67 | 720 | 70/1000 | 33/300 | 1/1000 | 1/300 | 99 | 119 |
| Invention | 11 | A5 | 67 | 660 | 73/950 | 35/300 | 1/1000 | 1/300 | 100 | 120 |
| Invention | 12 | A6 | 67 | 720 | 80/1050 | 31/300 | 0.5/1000 | 0/300 | 110 | 119 |
| Invention | 13 | A7 | 67 | 730 | 75/1050 | 29/300 | 0.5/1000 | 0/300 | 112 | 125 |
| Control | 14 | A8* | 67 | 980* | 78/1200 | 34/300 | 25/1000 | 15/300 | 65 | 105 |
| Control | 15 | A9* | 25 | None* | — | — | 5.5/1000 | 10/300 | 80 | 110 |

*indicates conditions outside the scope of the invention.

Effect of the Invention

By the process according to the invention there can be produced a high strength stainless steel strip excellent in shape without carrying out a step of rolling for shape rectification. The fact that the rolling step for shape rectification can be eliminated in the production of a stainless steel strip having a high tensile strength of the order of 100 kgf/mm$^2$ or higher greatly contributes to saving process steps and enhancing production yields. The strip prepared by the process according to the invention is excellent in not only strength but also fatigue resistance because of its duplex structure, and thus can be advantageously used as a material for producing belts and springs.

We claim:

1. A process for producing a high strength stainless steel strip excellent in shape having a duplex structure of austenite and martensite proof strength at least 90 kgf/mm$^2$, LD shape value not greater than 2/1000 (mm), and a TD shape value not greater than 1.5/300 (mm) which comprises providing a cold rolled or cold rolled and annealed strip of a martensitic structure from low carbon martensitic stainless steel containing from 10 to 17% by weight of Cr and having a carbon content not exceeding 0.15% by weight, causing the strip to continuously pass through a continuous heat treatment furnace under tension where the strip is heated to a temperature within the range from As point of the steel +30° C.) to Af point of the steel and not higher than 900° C. so that a part of the martensitic phase may be changed to a reversed austenitic phase, and cooling the heated strip to ambient temperature, wherein the As point of the steel is a temperature of the steel of which temperature is being raised at which the transformation of martensite to austenite begins and the Af point of the steel is a temperature of the steel of which temperature is being raised at which the transformation of martensite to austenite is finished.

2. The process according to claim 1 wherein a tension of the strip passing through the furnace is lowered as it is heated from a lower temperature side to a higher temperature side.

3. The process according to claim 2 wherein the tension of the strip is adjusted by changing a distance between adjacent rolls supporting the strip in the furnace.

4. The process according to claim 1, wherein the strip contains up to 20% by volume of a ferritic or austenitic phase before it is caused pass through the continuous heat treatment furnace.

5. The process according to claim 1, wherein the stainless steel contains, in addition to Cr and C, up to 8.0% by weight of Ni, up to 6.0% by weight of Si, up to 10.0% by weight of Mn and up to 0.3% by weight of N.

* * * * *